US009032583B2

(12) United States Patent
McLaughlin et al.

(10) Patent No.: US 9,032,583 B2
(45) Date of Patent: May 19, 2015

(54) ANTI-SLIP SHOE ACCESSORY FOR COURT SPORTS

(76) Inventors: Steve McLaughlin, York, PA (US); Seth McLaughlin, York, PA (US)

( * ) Notice: Subject to any disclaimer, the term of this patent is extended or adjusted under 35 U.S.C. 154(b) by 53 days.

(21) Appl. No.: 14/113,074

(22) PCT Filed: Apr. 26, 2012

(86) PCT No.: PCT/US2012/000220

§ 371 (c)(1),
(2), (4) Date: Oct. 21, 2013

(87) PCT Pub. No.: WO2012/148496

PCT Pub. Date: Nov. 1, 2012

(65) Prior Publication Data

US 2014/0047652 A1 Feb. 20, 2014

Related U.S. Application Data

(60) Provisional application No. 61/479,159, filed on Apr. 26, 2011.

(51) Int. Cl.

| | |
|---|---|
| ***A43B 23/00*** | (2006.01) |
| ***A47L 23/24*** | (2006.01) |
| ***A43B 3/00*** | (2006.01) |
| ***A43B 23/26*** | (2006.01) |
| ***A43B 5/10*** | (2006.01) |
| ***A43C 19/00*** | (2006.01) |
| ***A47L 23/04*** | (2006.01) |
| ***A47L 23/28*** | (2006.01) |
| ***A43B 13/22*** | (2006.01) |

(52) U.S. Cl.

CPC . *A47L 23/24* (2013.01); *A43B 3/00* (2013.01); *A43B 23/26* (2013.01); *A43B 5/10* (2013.01); *A43C 19/00* (2013.01); *A47L 23/04* (2013.01); *A47L 23/28* (2013.01); *A43B 13/22* (2013.01)

(58) Field of Classification Search

CPC ..... A47L 23/04; A47L 23/24; A47L 23/00; A43C 1/00; A43B 23/26

USPC ..... 15/210.1, 227, 244.3, 104.92, 104.93; 36/136, 54

See application file for complete search history.

(56) References Cited

U.S. PATENT DOCUMENTS

| | | | | |
|---|---|---|---|---|
| 4,823,426 | A | 4/1989 | Bragga | |
| 5,421,106 | A * | 6/1995 | Emrick | 36/136 |
| 5,471,768 | A | 12/1995 | Pryor | |
| 5,555,564 | A | 9/1996 | Welch | |
| 6,128,801 | A * | 10/2000 | Adzick et al. | 15/210.1 |
| 7,337,561 | B2 | 3/2008 | Potashnick | |
| 2007/0271715 | A1 | 11/2007 | Scoralle | |
| 2008/0190975 | A1 | 8/2008 | Naughton | |

* cited by examiner

*Primary Examiner* — Shay Karls

(74) *Attorney, Agent, or Firm* — Ober, Kaler, Grimes & Shriver; Royal W. Craig

(57) ABSTRACT

A traction-enhancing cleaning kit for allowing sports players to clean and dry the soles of their court shoes while in-play. The cleaning kit comprises a gellified shoe cleaning fluid (3), and a shoe-attachable cleaning and drying device (1) comprising a gel-absorbent cleaning/drying cartridge (2) removably secured by hook-and-loop to a carrier platform (4), which is in turn secured along the forefoot of the sneaker by its laces. The cartridge (2) includes an encapsulated viscose rayon microfiber panel (20) backed by a moisture-impermeable layer (30), and held captive in a plastic frame (10). The frame (10) includes a raised wiping lip (114) surrounding the panel (20). In use, the player need only swipe one foot over the top of the cleaning and drying device (1) attached to the other foot, brushing the sole. One swipe wets and squeegees dry, and the process is repeated for the other foot.

11 Claims, 4 Drawing Sheets

ANTI-SLIP SHOE ACCESSORY FOR COURT SPORTS

BACKGROUND OF THE INVENTION

1. Field of the Invention

The present invention relates to devices for improving the traction of sport shoes used on court surfaces and, more particularly, to an anti-slip shoe accessory for court sports such as basketball, volleyball, racquetball and the like which is worn on the shoes.

2. Description of the Background

It is well known that athletes require good footing and traction between their footwear and the playing surface to avoid injury and perform at the highest level. Athletic shoes are designed to provide high traction between the sole of the shoe and the playing surface. Where the sole becomes dirty during play its ability to provide traction to the player may be compromised.

For example, when playing basketball on a dusty court, a player might realize partway through a game that the dust is affecting traction. Even on clean surfaces, bad traction can lead to injury.

Traction may be restored by cleaning the sole of the shoe. Fortunately, this is a simple affair. There are commercially available mats for shoes called Stick'Ums™. These may be placed on the basketball court sideline and players can step on it before or during the game. These mats have a top layer of adhesive-coated film that effectively removes dirt from shoes. The players simply step on the mat to remove dust. Alternatively, there are a variety of alcohol-based traction solutions available from sporting goods stores. These can be used to wet a towel which is placed on the sidelines so that players can wipe the bottom of their shoes. Though both the foregoing can be accomplished in just moments, they require the player to return to court-side, and so players must wait until short breaks in play. This is no help during play. Consequently, even professional basketball players are often seen licking their fingers while on the court and wiping the bottom of each shoe with their fingers. For obvious reasons physicians advise against this.

What is needed is a cleaning pad that can be secured to the shoe to provide a readily accessible cleaning element without the need to visit the sideline.

There have been a few past efforts toward this end.

For example, U.S. Pat. No. 4,823,426 to Bragga issued Apr. 25, 1989 discloses a Velcro™-attached shoe pad for dislodging, and picking up and retaining foreign particles and other matter adhered on athletic footwear soles. The cloth pad relies on mechanical brushing to clean.

U.S. Pat. No. 5,421,106 to Emrick issued Jun. 6, 1995 discloses a removable shoestring cover for athletic shoes which provides an upwardly facing wiping surface of suede or other material, and which cover is attached to the shoestrings at the upper and lower edge of the cover by flaps which fold around portions of the shoestrings and are held by a hook and loop type fastener.

U.S. Pat. No. 5,471,768 to Pryor issued Dec. 5, 1995 discloses a sneaker with built in atomizer for improved traction.

U.S. Pat. No. 5,555,564 to Welch discloses a shoe sole wiping pad sewn to the outer surface of an athletic sock. The wiping pad has a moisture-bearing wiping surface that removes dust and debris from the sole of an athletic shoe. The wiping pad cannot be removed from the sock for moisture replenishment.

U.S. Pat. No. 6,128,801 to Adzick et al. issued Oct. 10, 2000 discloses a shoe sole cleaner that removes debris from a sole of a user's shoe by swiping the sole over the shoe sole cleaner on the user's opposing shoe. A two-part mechanical fastener (e.g., hook-and-loop) secures the shoe sole cleaner to a shoe by its shoe laces. Again, the cloth pad relies on mechanical brushing to clean.

U.S. patent application Ser. No. 12/106,410 by Naughton filed Apr. 21, 2008 discloses a wearable wipe unit essentially comprising a Velcro™ attached towel.

Although the foregoing references are attached to the shoe or sock and can be used during game play, they primarily rely on mechanical brushing and are not very effective. A cleaning fluid is the most effective traction enhancer. However, simply impregnating a cleaning pad and attaching to a sneaker results in a relatively heavy device when worn, and impedes quickness. Moreover, any wetted or impregnated pad will tend to leave a residue on the soles, temporarily reducing traction. Even worse, the fluids can leach, spray or splatter during the game, resulting in wet shoes and socks. Even worse, the devices can leave moisture on the court and create substantial safety issues. What is needed is a light-weight low-profile cleaning pad assembly that can be removably secured to the shoe, designed to entrap a semisolid gel cleaner which avoids leaching, spraying or splattering of the gel.

SUMMARY OF THE INVENTION

It is, therefore, an object of the invention to provide a gel-impregnated cleaning pad for court shoes that is worn on the shoes and is extremely light weight (4 ounces or less) so as not to impede performance.

It is another object to provide a court-shoe cleaning pad as above that can be easily secured to the shoe to provide a readily accessible gel-cleaning element.

It is another object to provide a court-shoe cleaning pad as above that provides a readily accessible gel-cleaning and sequential drying element, e.g., a specially-designed gel-retaining pad within an encapsulating sneaker-attached cartridge that surrounds the pad with an integral wiping lip.

It is another object to provide a combination semi-solid (gellified) cleaner in combination with a specially-designed gel-absorbing cleaning pad to avoid leaching, spraying or splattering of the gel.

It is another object to provide a gel-absorbent court-shoe cleaning pad that is firmly secured to the shoe during play, yet easily removable for gel-replenishment or laundering.

In accordance with the foregoing objects, the present invention provides a combination kit including a particular gellified shoe cleaning fluid, a gel-retentive absorbent sole cleaning assembly, and an anchoring platform that can be secured to a shoe for removably attaching the sole cleaning assembly thereto. The sole cleaning assembly can be impregnated with the cleaning gel to provide a readily accessible court-shoe sole cleaning solution during game play and without the need to visit the sideline. The combination of materials used for the shoe cleaning gel, and for the gel-absorbent sole cleaning assembly avoids evaporation of the gel during play, and also avoids leaching, spraying or splattering of fluid during the game. The sole cleaning assembly includes a cleaning pad comprising a non-woven microfiber layer attached to a moisture-impermeable base layer, the two layers being held captive inside a surrounding plastic frame. In an embodiment, the plastic frame is substantially ovoid or elliptical and surrounds the cleaning pad, which is similarly-shaped. The cleaning pad may be sewn and/or adhered inside the plastic frame. The base layer is formed with a central elevation running centrally lengthwise along its major axis, which underlies the microfiber layer and elevates it slightly above the surrounding plastic frame. The surrounding plastic frame is formed with a raised wiper lip surrounding the cleaning pad so that as a shoe sole is brushed across the gel-wetted cleaning pad any residual gel is wiped clean by the raised wiper lip. A hook-and-loop attachment pad underlies the base layer, and a mating hook-and-loop attachment pad is mounted atop an anchoring platform which is laced to the user's sneaker. This allows the sole cleaning assembly to be removably attached along the forefoot of the sneaker via the platform so that it can be removed for easier gel-replenishment and/or cleaning.

In use, with the cleaning pad impregnated with gel cleaner and the entire sole cleaning assembly removably attached to the forefoot of the sneaker via the anchoring platform, the user simply brushes the sole of his opposing sneaker overtop/against the sole cleaning assembly. The entire length of the sole makes rubbing contact transversely across it, chemically cleaning the sole and the wiper lip of the frame immediately wiping excess or residue back into the absorbent pad. The process is repeated for the other foot. The device is remarkably effective at cleaning the soles of court-shoes and significantly improves traction. Moreover, the device is very lightweight (4 oz per foot), and can be used on-court anytime without the need to visit the sideline. The sequential fluid-cleaning and wiping/drying avoids leaving any residue on the shoes, and the combination of gellified cleaning fluid, gel-absorbing cleaning pad, and encapsulating frame avoids leaching, spraying or splattering of the gel fluid during play, all of which improves court safety.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

Reference will now be made in detail to preferred embodiments of the present invention, examples of which are illustrated in the accompanying drawings. Wherever possible, the same reference numbers will be used throughout the drawings to refer to the same or like parts.

The present invention is a combination kit, including a particular gellified shoe cleaning fluid, and gel-absorbent court-shoe cleaning and drying device that can be secured to the shoes to provide a readily accessible sole-cleaning and drying solution during game play, to improve traction without the need to visit the sidelines.

Figure 1:
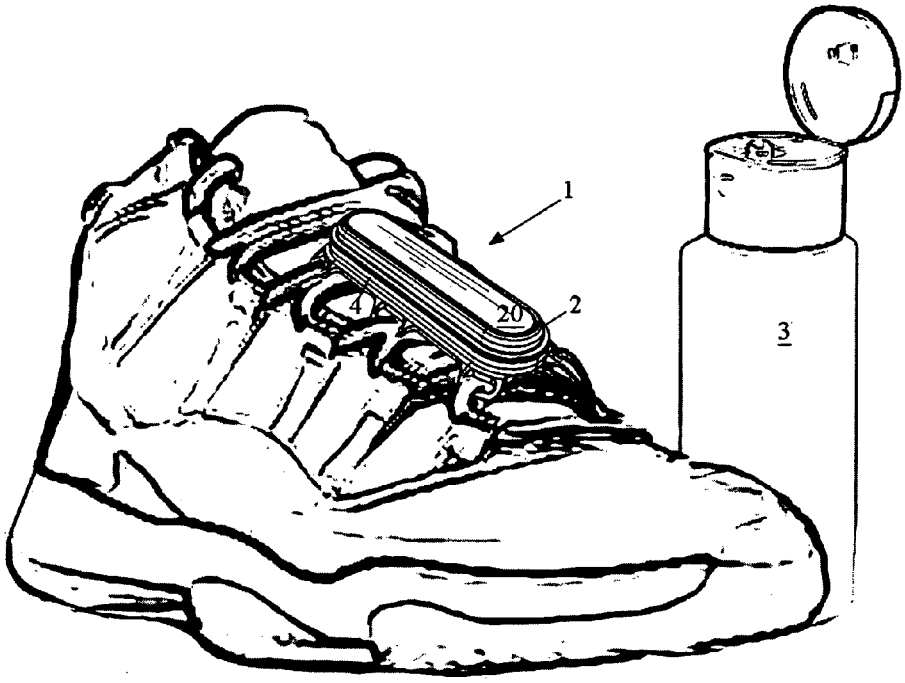
FIG. 1 is a perspective illustration of a basketball court-shoe with a gel-absorbing court-shoe cleaning and drying device attached thereto in accordance with an embodiment of the invention.

FIG. 1 is a perspective illustration of a basketball court-shoe with a gel-absorbing court-shoe cleaning and drying device 1 attached thereto in accordance with an embodiment of the invention. The device is a kit inclusive of both a dropper vial 3 of gellified shoe cleaning fluid, plus a cleaning/drying device 1 that uses the cleaning gel. The cleaning/drying device includes a court-shoe cleaning and drying cartridge 2 that is removably attached atop a carrier platform 4 which is in turn attached to the shoe laces. The cleaning/drying cartridge 2 includes a gel-absorbent fabric pad 20 impregnated with the cleaning gel from dropper vial 3. The combination of materials used for the shoe cleaning gel and fabric pad 20, as well as the design details of the cleaning/drying cartridge 2, encapsulates the gel during play and avoids evaporation, as well as leaching, spraying or splattering of gel during the game.

The dropper vial 3 is a commercially available flip-top plastic dropper vial. Vial 3 is preferably filled with a gel-viscosity glycerin/ethanol gel soap and tackifier solution consisting essentially of water, denatured alcohol, glycerin compound, gellifier(s), optional benzoic acid, plus fragrance and coloring agent(s) as a matter of design choice. The presently-preferred embodiment comprises 1 part glycerin, 1 part denatured alcohol, 3 parts water, gellifier, food coloring, and a bitter additive such as denatonium benzoate to deter anyone from drinking it. If desired, the benzoic acid may be added as an antimicrobial preservative. Glycerine also has an antibacterial potential, which alone or in combination with the benzoic acid has an added biocidal advantage. Basketballs and the courts that they touch, as well as the shoes that contact the court, are all well-known bacterial hotbeds. The preferred gellifier for the foregoing is polyacrylic acid added to reach a viscosity of between 5000-15000 cP, which is best suited for absorption into the fabric pad 20. Vegetable gums (agar, pectin, alginates, etc.) are possible alternative gellifiers. An alternative gel soap and tackifier solution may comprise polyethylene glycol (PEG) or methoxypolyethylene glycol (mPEG) cleaner, or other suitable PEG/mPEG detergents available from Dow Chemical under the trademark Carbowax™. Note that whether PEG, mPEG, glycerine cleaner, or some combination is used, these compounds are well-suited because they are completely non-toxic and non-acidic, and cannot not harm court floors.

Figure 2:
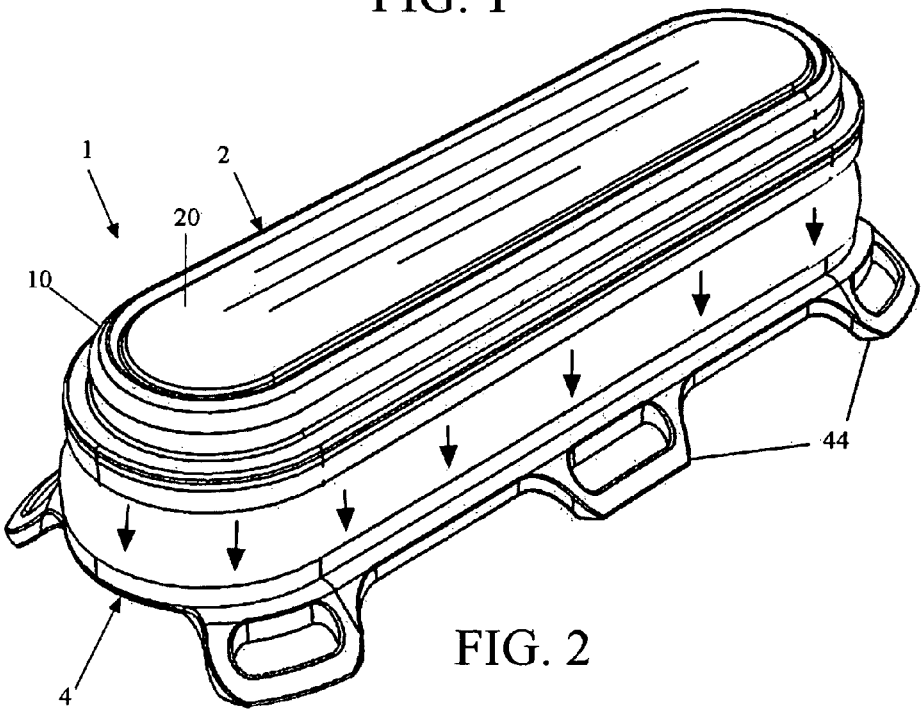
FIG. 2 is a perspective illustration of the of the court-shoe cleaning and drying device 1 with gel-absorbing court-shoe cleaning and drying cartridge 2 shown removed from its underlying attachment platform 4.

FIG. 2 is a perspective illustration of the cleaning/drying device 1 comprising the carrier platform 4 laceable to the shoe, and the court-shoe cleaning/drying cartridge 2 adhered by hook-and-loop to the top of the carrier platform 4 (here shown removed from its underlying platform 4). The cleaning/drying cartridge 2 includes a plastic frame 10 encapsulating an absorbent fabric pad 20. As will be described, fabric pad 20 is preferably a non-woven microfiber layer backed by a moisture-impermeable layer and held captive inside the surrounding plastic frame 10. In an embodiment, the plastic frame 10 is substantially ovoid or elliptical and surrounds the absorbent fabric pad 20, which is similarly-shaped. The absorbent fabric pad 20 may be sewn and/or adhered inside the plastic frame 10.

In use, with the cleaning pad 20 impregnated with gel cleaner from vial 3 and the entire sole cleaning assembly 1 removably attached along the forefoot of the sneaker approximately over the second and third metatarsal bones, by tying the anchoring platform 4 to the laces as seen in FIG. 1. The device 1 is self-aligned along the forefoot of the sneaker and the user simply brushes the sole of his opposing sneaker overtop/against the sole cleaning assembly. The entire length of the sole makes rubbing contact transversely across it, chemically cleaning the sole and scraping excess or residue back into the absorbent pad 20. Two such devices may be worn (one per shoe) so that the process may be repeated for the other sole. Each device 1 is remarkably effective at cleaning the sole of the opposing court-shoe and significantly improves traction. Moreover, each device 1 is very lightweight (4 oz per foot), and can be used on-court anytime without the need to visit the sideline. The sequential fluid-cleaning and wiping/drying avoids leaving any residue on the shoes, and the combination of gellified cleaning fluid 3, gel-absorbing cleaning pad 20, and encapsulating frame avoids leaching, spraying or splattering of the gel fluid during play, all of which improves court safety.

Figure 3:
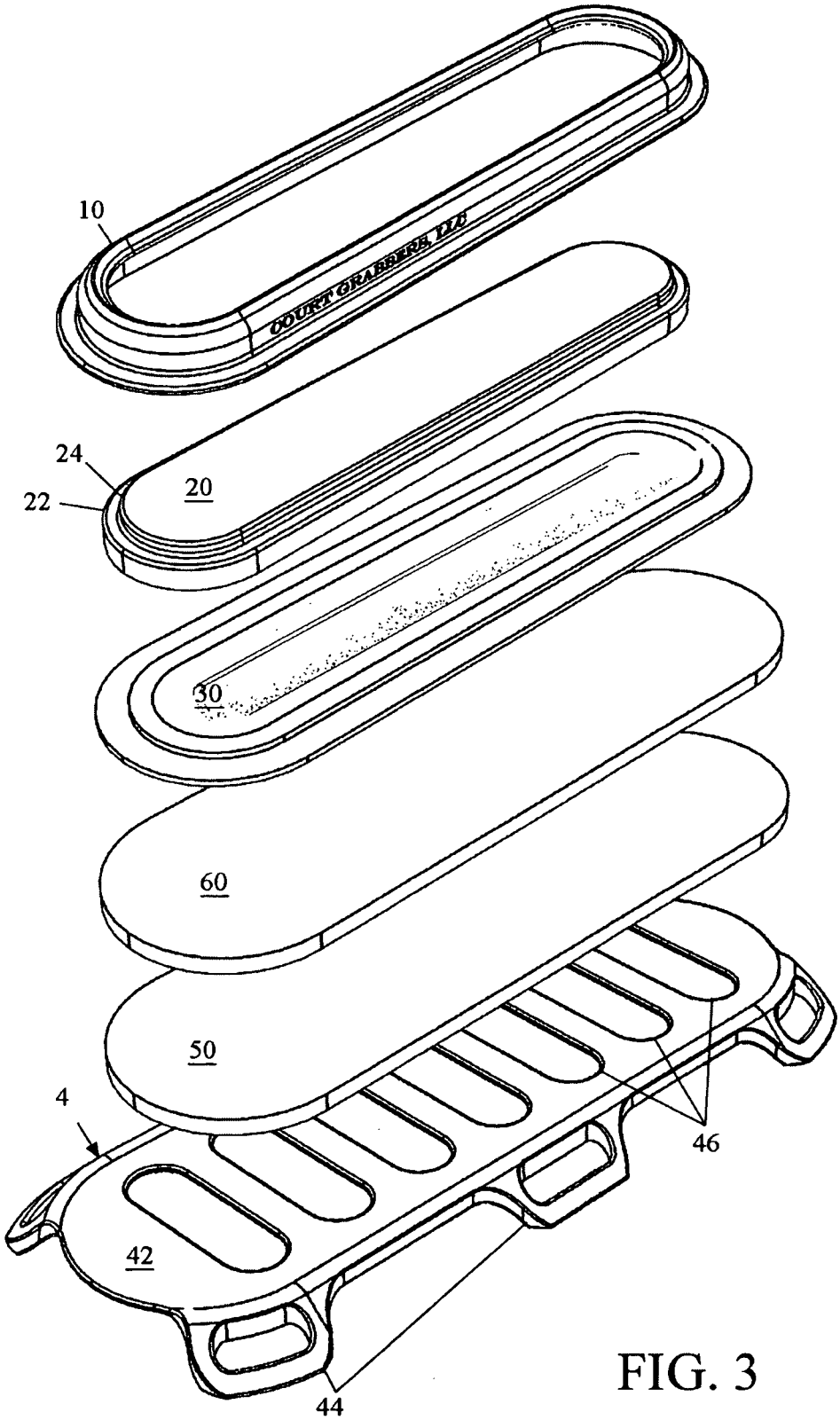
FIG. 3 is an exploded perspective view of the various components and layers of the court-shoe cleaning and drying device 1.

FIG. 3 is an exploded perspective view of the various components and layers of the court-shoe cleaning and drying device 1.

From bottom, the carrier platform 4 comprises a substantially flat plastic member formed in an elongate rectangular or oblong/ovoid surface 42 and having a plurality of pairs of stirrups 44 protruding downward from the surface 42 along both flanking sides. Each pair of stirrups 44 directly oppose each other and serve as pass-through anchors for lacing the carrier platform 4 to the forefoot of the sneaker. When laced tight as shown in FIG. 1 the carrier platform self-aligns the cleaning/drying device 1 so that it remains oriented along the forefoot of the sneaker. In a preferred embodiment the elongate rectangular or oblong/ovoid surface 42 is interrupted by apertures 46 to reduce weight and increase breathability.

A first hook-and-loop pad 50 comprises a self-adhesive hook and loop pad formed in the same elongate rectangular or oblong/ovoid shape as surface 42 and adhered thereto with hook-and-loop attachment surface directed upwardly.

A second hook-and-loop pad 60 comprises the opposing self-adhesive hook and loop pad adhered beneath the cleaning/drying cartridge 2 so that it can be removably attached atop the carrier platform 4.

The cleaning/drying cartridge 2 comprises the absorbent fabric pad 20 sandwiched between the surrounding frame 10 and a moisture-proof backing 30. The absorbent fabric pad 20 comprises a non-woven viscose rayon/cellulose panel likewise cut/formed in the same elongate rectangular or oblong/ovoid shape. Specifically, a super absorbent shammy-type cloth of 80% viscose and 20% polyester is presently-preferred, cut from a 0.317-0.635 cm (⅛-¼") thick cloth blank for proper gel-carrying capacity, into a 3-4" long by 0.75-1.5" wide oblong section. What is necessary is that the top-to-bottom dimension of the cleaning/drying pad 20 equal or exceed the breadth of the shoe sole, which is approximately 3.5". In addition, the cloth preferably has a gsm weight of 260 within an acceptable range of from 200-300.

In the illustrated embodiment, the absorbent fabric pad 20 comprises an oblong section of non-woven viscose rayon/cellulose cloth 3" long and 1.5" wide. If desired, the absorbent fabric pad 20 may be silkscreened with team or corporate logos, or other branding indicia.

The absorbent fabric pad 20 is sewn and/or adhered to a like-shaped waterproof backing layer 30 which prevents leaching of the gel cleaner. In the preferred embodiment the waterproof backing layer 30 is preferably a thin section of plastic sheet pre-molded to retain a convex configuration, with a raised surface feature 24 defining a hump or other protrusion. This way, when used as a backing for the absorbent fabric pad 20 the raised surface feature 24 elevates the fabric pad 20 above the surrounding frame 10 thereby ensuring that when a sneaker sole is swiped across it makes firm contact with the raised surface of the fabric pad 20 and is fully exposed to the gel absorbed therein.

Figure 4:
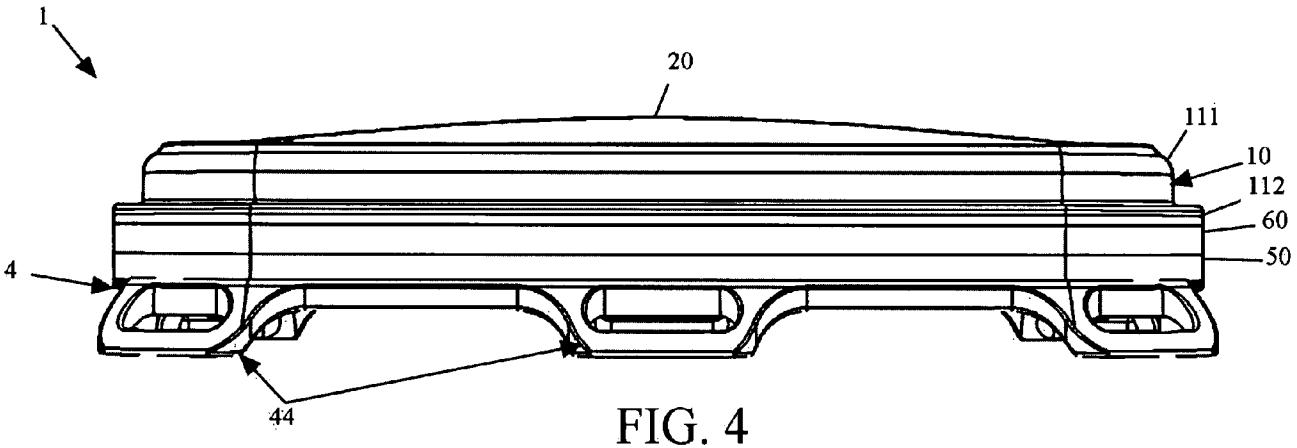
FIG. 4 is a side perspective illustration of the cleaning/drying device 1 comprising the carrier platform 4 laceable to the shoe.
Figure 5:
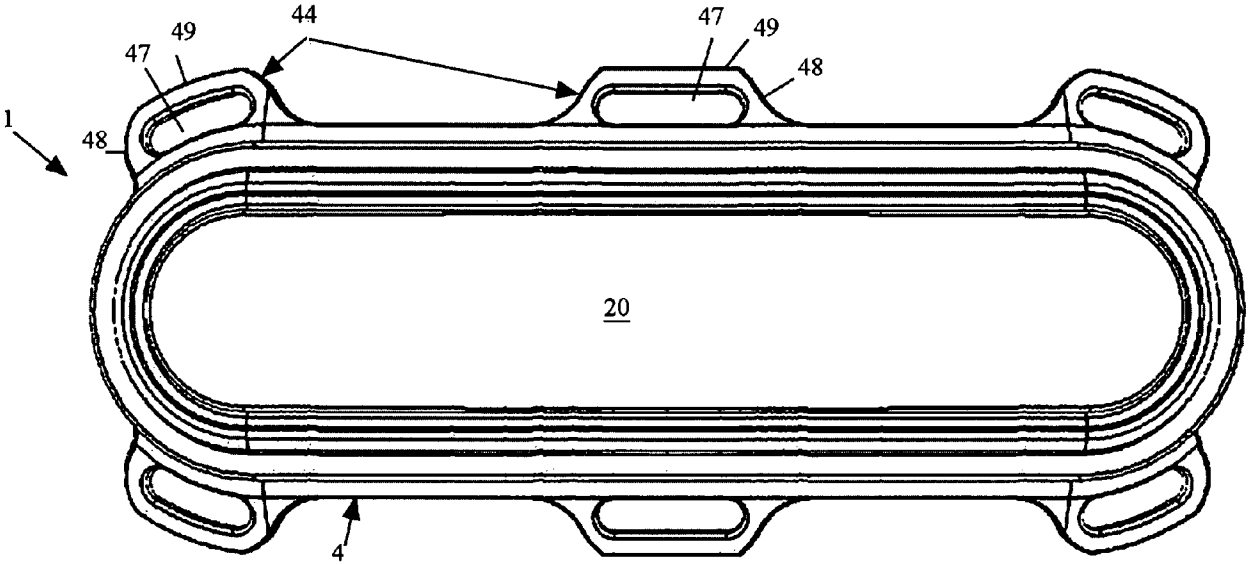
FIG. 5 is a top perspective illustration of the cleaning/drying device 1.

FIG. 4 is a side perspective illustration of the cleaning/drying device 1 comprising the carrier platform 4 laceable to the shoe, and FIG. 5 is a top view. The court-shoe cleaning/drying cartridge 2 adhered by hook-and-loop layers 50, 60 to the top of the carrier platform 4. The absorbent fabric pad 20 and backing layer 30 may be sewn and/or adhered inside frame 10. In the illustrated embodiment there are three pair of stirrups 44 flanking both ends and the midsection of the platform 42. Each stirrup 44 comprises an integrally molded plastic loop protruding downward and outward from the platform 42, effectively forming a standing hexapod. Preferably, each stirrup 44 protrudes downward and outward at a 45 degree angle approximately ¼" so that the platform 42 stands on six (6) legs approximately ⅛" above the sneaker. The sneaker is worn so that the laces pass through the stirrups 44 in a criss-cross manner when tied normally, and ample clearance is provided for the laces to pass underneath the platform 42.

Figure 6:
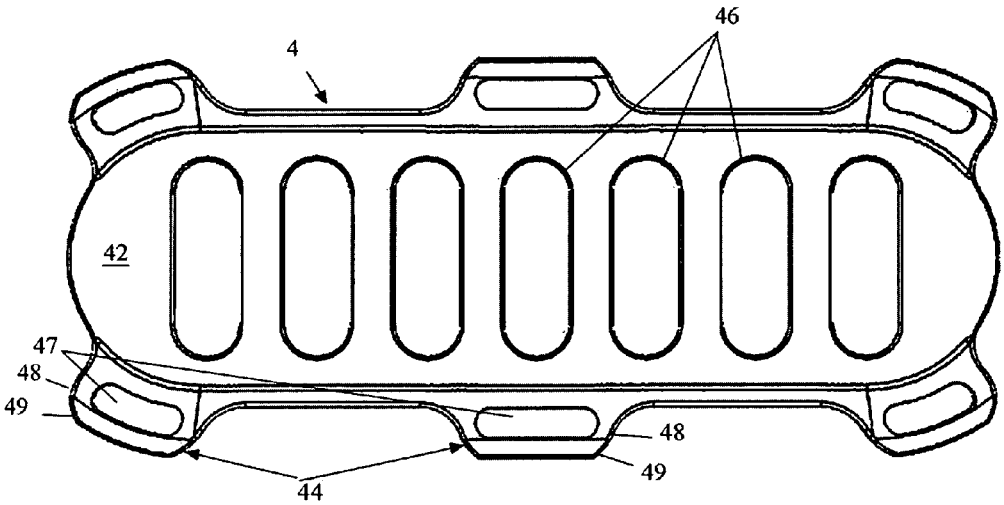
FIG. 6 is an overhead perspective illustration of the carrier platform 4 illustrating the hexapod configuration.

FIG. 6 is an overhead perspective illustration of the carrier platform 4 illustrating the hexapod configuration. The hexapodal configuration achieves the requisite anchoring stability with fewest anchor points (3 pair), thereby reducing the weight and bulk of the platform 4. Moreover, the stirrup configuration is best-suited for accommodating the wide variety of court shoes which include shoes with eyelets and lugs instead of eyelets. A typical sneaker will have a horizontal lace spacing of 50 mm and a criss-cross pattern with five pairs of eyelets or lugs, though both spacing and lugs/eyelets will vary. Moreover, players often lace the shoe in a direct horizontal pattern avoiding a criss-cross configuration. As best seen in FIG. 6, the preferred stirrup 44 comprises an oblong ⅛-¼" aperture 47 set within a slightly larger flange 48 that protrudes downward and outward at a 45 degree angle to a flat reinforced base 49, so that the platform 42 is elevated approximately ¼" above the laces and sits atop the sneaker squarely upon the six flat reinforced bases 49. Each aperture 47 is positioned proximate a corresponding eyelet or lug, and the oblong extent of apertures 47 affords ample tolerance for the laces to pass there through regardless of differences in the number or spacing of eyelets or lugs, or lacing style.

Figure 7:
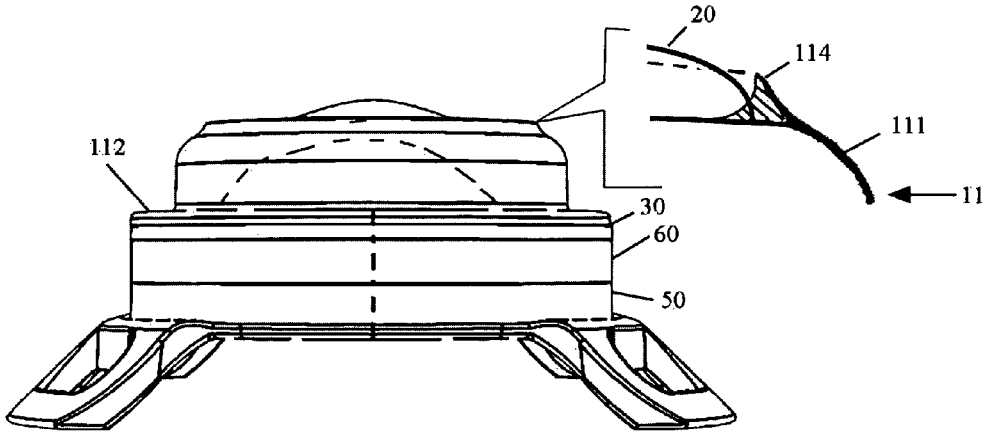
FIG. 7 is an end perspective illustration of the cleaning/drying device 1 with cleaning/drying cartridge 2 attached to carrier platform 4.

FIG. 7 is an end perspective illustration of the cleaning/drying device 1 with cleaning/drying cartridge 2 attached to carrier platform 4. The surrounding plastic frame 10 is formed as rigid open-faced structure with arched side walls 111 that surround and enclose the exposed edges of the absorbent fabric pad 20, leaving a majority of the absorbent fabric pad 20 exposed there through. The side walls 111 of frame 10 run to a horizontal flange 112 that centers the frame 10 atop platform 44, and also provides a lateral surface for attachment of the frame 10 to moisture-impermeable base layer 30. Specifically, the base layer 30 (with absorbent pad 20 attached atop it) may be sewn and/or bonded to the flange 112 beneath the frame 10.

As best seen in the inset of FIG. 7, the surrounding plastic frame 10 is formed with a raised wiper lip 114 surrounding the cleaning pad 20. Wiper lip 114 comprises a raised wall surrounding the entire frame 10 and extending a scraping edge over the sides of the cleaning pad 20. This way, as a shoe sole is brushed across the cleaning pad 20 any gel deposited onto the shoe sole is scraped off by wiper lip 114 and resorbed back into the cleaning pad 20. This avoids messy over-wetted soles and conserves gel.

As indicated above, a hook-and-loop attachment pad 60 is adhered beneath the base layer 30, and a mating hook-and-loop attachment pad 50 is mounted atop the anchoring platform 40 which is laced to the user's sneaker. This allows the sole cleaning assembly to be removably attached along the forefoot of the sneaker via the platform so that it can be removed for easier gel-replenishment and/or cleaning. FIG. 7 also illustrates how the raised surface feature 24 (convex bubble or ridge) molded into the waterproof backing layer 30 elevates the fabric pad 20 above the lip 114 of the surrounding frame 10 thereby ensuring that when a sneaker sole is swiped across it makes firm contact with the raised surface of the fabric pad 20 and is fully exposed to the gel absorbed therein. The waterproof backing layer 30 prevents the gel from migrating out of the pad 20, and in conjunction with the surrounding plastic frame 10 essentially encapsulates the fabric pad 20 so that gel cannot leach out.

In use, and referring back to FIG. 1, a player detaches the cleaning/drying cartridge 2 from the carrier platform 4 and applies a single line of gel from container 3 along the exposed fabric pad 20. The cleaning/drying cartridge 2 is then re-adhered by hook-and-loop pads 50, 60 atop the carrier platform 4 so that it extends lengthwise along the top of the foot. The gel quickly absorbs and is entrapped within the fabric pad 20 bounded by the waterproof backing 30 and the surrounding moisture-proof frame 10. During play, the player need only swipe each foot once over the top of the cleaning/drying pad attached to the other foot, brushing the sole against the cleaning/drying pad. The entire length of the foot makes rubbing contact transversely across the fabric pad 20 and is fully exposed to the gel absorbed therein, and residual gel adhered to the sneaker sole is wiped free by wiper lip 114. The process may be repeated for the other foot. The sequential fluid-cleaning and drying is remarkably effective at cleaning the soles of both shoes and significantly improves traction. Simply wiping a sole on a glycerin-impregnated towel leaves a fluid residue that quickly picks up dust and dirt during play, defeating its own purpose. However, wiping followed by immediate drying avoids this. Moreover, immediate drying avoids splattering of any residue onto the shoes, and the encapsulation within frame 10 avoids leaching, spraying or splattering of the gel fluid during play, all of which improves court safety. The gel viscosity and thickness of the cleaning and drying pad 20 is calculated to maintain moisture and effectiveness for a complete basketball game. When it becomes necessary to replenish the gel or launder the cleaning and drying pad 20, it can be conveniently removed by pulling it off the attachment platform 44.

It should now be apparent that the above-described invention provides an effective anti-slip shoe accessory for cleaning the soles of court shoes such as basketball, volleyball, racquetball and other shoes, which is worn on the shoes for on-demand use even during play, without the need to visit the sideline. The gel cleaner and thick, absorbent viscose rayon/cellulose panel 20 encapsulated in a waterproof frame 10 avoids leaching, spraying or splattering of the gel even during active play, improving traction and court safety. Moreover, the biocidal nature of the gel improves sanitary conditions. Those skilled in the art will understand that various modifications and variations can be made in the present invention without departing from the spirit or scope of the invention. It is to be understood, therefore, that the invention may be practiced otherwise than as specifically set forth in the appended claims.

INDUSTRIAL APPLICABILITY

Athletes participating in court sports such as basketball perform at their highest level when they have good footing and traction on the playing surface. For this reason many athletes keep a towel wetted with cleaning liquid handy on the sidelines to that they can run over and swipe their soles periodically. Of course, this is not possible during live game play, and such towels tend to leave excess fluids on the sole that can leach, spray or splatter during the game, resulting in wet shoes and socks. Even worse, the devices can leave moisture on the court and create substantial safety issues. There would be great industrial applicability in a light-weight low-profile cleaning pad assembly that can be removably secured to the shoe, designed to entrap a semisolid gel cleaner which avoids leaching, spraying or splattering of the gel.

We claim:

1. A traction-enhancing kit for cleaning a sole of a court shoe, comprising:

a container containing a gellified cleaning and tackifier solution;

a carrier platform having an elongate flat supporting surface and a plurality of stirrups protruding from said platform for lacing said carrier platform to a forefoot of one shoe of a pair of court shoes;

a cleaning and drying cartridge removably attached to said carrier platform lengthwise along the forefoot of said court shoe, said cleaning and drying cartridge further comprising a recessed frame surrounded by a raised wiper lip, and a gel-absorbent cleaning pad held captive in said frame and surrounded by said wiper lip, said cleaning pad further comprising a moisture-impermeable layer adhered beneath an absorbent fabric layer for absorption of said gellified cleaning and tackifier solution from said container.

2. The traction-enhancing kit for cleaning a court-shoe sole according to claim 1, wherein said gellified cleaning and tackifier solution consists essentially of water, benzoic acid, glycerin and a gellifier agent.

3. The traction-enhancing kit for cleaning a court-shoo sole according to claim 1, wherein said supporting surface of said carrier platform, cleaning and drying cartridge, and fabric cleaning pad all have an oblong shape.

4. The traction-enhancing kit for cleaning a court-shoe sole according to claim 1, wherein the wiper lip of said cleaning and drying cartridge is raised above the cleaning and drying pad to scrape residual gel from the sole of another of said pair of court shoes.

5. The traction-enhancing kit for cleaning a court-shoe sole according to claim 4, wherein said stirrups protrude downward as legs from said carrier platform for standing said carrier platform at an elevation above said forefoot of said court shoe.

6. The traction-enhancing kit for cleaning a court-shoe sole according to claim 1, wherein said carrier platform comprises a first hook-and-loop pad attached atop said elongate supporting surface, and said cleaning and drying cartridge comprises a second hook-and-loop pad attached there beneath, said cleaning and drying cartridge being removably attached to said carrier platform by said opposing first hook-and-loop pad and second hook-and-loop pad.

7. The traction-enhancing kit for cleaning a court-shoe sole according to claim 1, wherein said cleaning and drying pad comprises an absorbent viscose rayon panel.

8. The traction-enhancing kit for cleaning a court-shoe sole according to claim 3, wherein said carrier platform has an oblong recess bounded by said raised wiper lip for nested seating of said cleaning and drying cartridge on said carrier platform.

9. The traction-enhancing kit for cleaning a court-shoe sole according to claim 3, wherein said cleaning and drying cartridge comprises said fabric cleaning pad, a waterproof backing attached to one side of said fabric cleaning pad, and an open-faced plastic frame for covering said fabric cleaning pad edgewise.

10. The traction-enhancing kit for cleaning a court-shoe sole according to claim 9, wherein said open-faced plastic frame has an oblong shape.

11. The traction-enhancing kit for cleaning a court-shoe sole according to claim 9, wherein said plastic frame has a raised wiping lip surrounding said open-face.

* * * * *